US007320201B2

(12) United States Patent
Kitchen et al.

(10) Patent No.: US 7,320,201 B2
(45) Date of Patent: Jan. 22, 2008

(54) WALL CONSTRUCTION

(75) Inventors: Robert Kitchen, Mahaffey, PA (US); Duane Priddy, Sr., Midland, MI (US)

(73) Assignee: Snap Block Corp., Mahaffey, PA (US)

( * ) Notice: Subject to any disclaimer, the term of this patent is extended or adjusted under 35 U.S.C. 154(b) by 296 days.

(21) Appl. No.: 11/217,963

(22) Filed: Sep. 1, 2005

(65) Prior Publication Data

US 2006/0265972 A1 Nov. 30, 2006

Related U.S. Application Data

(60) Provisional application No. 60/685,838, filed on May 31, 2005.

(51) Int. Cl.
*E04B 2/32* (2006.01)
*E04B 1/38* (2006.01)
*E04C 1/00* (2006.01)

(52) U.S. Cl. ..... 52/426; 52/309.11; 52/432; 52/562; 52/565; 52/568; 52/572

(58) Field of Classification Search ..... 52/309.11, 52/426, 428, 429, 431, 432, 562, 563, 565, 52/568, 572, 794.1, 275, 582.1, 585.1, 285.1; 249/190, 191, 213
See application file for complete search history.

(56) References Cited

U.S. PATENT DOCUMENTS 1,038,257 A * 9/1912 Yourelle ..... 52/307
1,240,690 A * 9/1917 Egloff
2,326,361 A * 8/1943 Jacobsen
3,160,245 A * 12/1964 Pavlecka ..... 52/275
3,184,013 A * 5/1965 Paulecka
3,279,137 A * 10/1966 Paulecka
3,992,839 A * 11/1976 La Borde
4,180,956 A * 1/1980 Gross ..... 52/407.1
4,229,920 A * 10/1980 Lount ..... 52/309.12
4,678,156 A * 7/1987 Scalamandre et al.
4,703,602 A 11/1987 Pardo
4,884,382 A 12/1989 Horobin
5,086,600 A 2/1992 Holland et al.
5,092,093 A * 3/1992 Lu
5,311,718 A * 5/1994 Trousilek ..... 52/425
5,459,970 A * 10/1995 Kim
5,570,552 A 11/1996 Nehring
5,692,356 A * 12/1997 Baxter
5,740,648 A * 4/1998 Piccone ..... 52/426
5,809,728 A * 9/1998 Tremelling ..... 52/426
5,855,102 A 1/1999 Chang
5,904,019 A 5/1999 Kooij et al.
5,983,585 A * 11/1999 Spakousky
5,992,102 A 11/1999 Ozawa
6,247,280 B1 * 6/2001 Grinshpun et al.
6,321,497 B1 * 11/2001 Cormier ..... 52/425
6,405,505 B1 * 6/2002 Alberti (Continued)

*Primary Examiner*—Robert Canfield
(74) *Attorney, Agent, or Firm*—Timothy S. Stevens

(57) ABSTRACT

A kit for forming a hollow block assembly to be used to construct a wall, the kit consisting of two face panels and a plurality of fasteners, each face panel comprising a plurality of spaced apart flanges extending perpendicularly from and attached to each panel so that a hollow block structure is assembled when the flanges of the face panels are connected together, directly or indirectly, by the fasteners.

8 Claims, 14 Drawing Sheets

U.S. PATENT DOCUMENTS 6,438,917 B2 * 8/2002 Kubica
6,523,312 B2 2/2003 Budge
6,536,172 B1 3/2003 Amend
6,739,797 B1 5/2004 Schneider

* cited by examiner

WALL CONSTRUCTION

PRIORITY

This application claims priority from U.S. Provisional Application No. 60/685,838 filed May 31, 2005.

FIELD

The instant invention is in the field of wall construction. More specifically, the instant invention relates to modular panels for wall construction such as leave-in-place forms for poured concrete walls.

BACKGROUND OF THE INVENTION

Forms for poured concrete walls comprising interlocking hollow blocks are known, see, for example, U.S. Pat. Nos. 4,703,602; 5,086,600; 5,855,102; 5,992,102 and 6,536,172. Forms for poured concrete walls comprising modular panels are known, see, for example, U.S. Pat. Nos. 4,884,382; 5,570,552; 5,983,585; and 6,405,505. However, none of the prior art technology takes full advantage of injection molded components.

SUMMARY OF THE INVENTION

An important benefit of the instant invention is that it allows a single user to incorporate several phases of construction into a single phase, thereby creating a finished wall. The instant invention is a kit for forming a hollow block to be used to construct a wall, the kit comprising: at least two face panels and a plurality of fasteners, each face panel comprising a plurality of spaced apart flanges extending perpendicularly from and attached to each panel so that a hollow block structure is assembled when the flanges of the face panels are connected together, directly or indirectly, by the fasteners.

In another embodiment, the instant invention is a hollow block assembly to be used to construct a wall, comprising: two face panels, each face panel comprising a plurality of spaced apart flanges extending perpendicularly from and attached to each panel, the flanges of one face panel facing and aligned with the flanges of the other face panel; and a plurality of fasteners connecting the flanges together.

DETAILED DESCRIPTION

Figure 1:
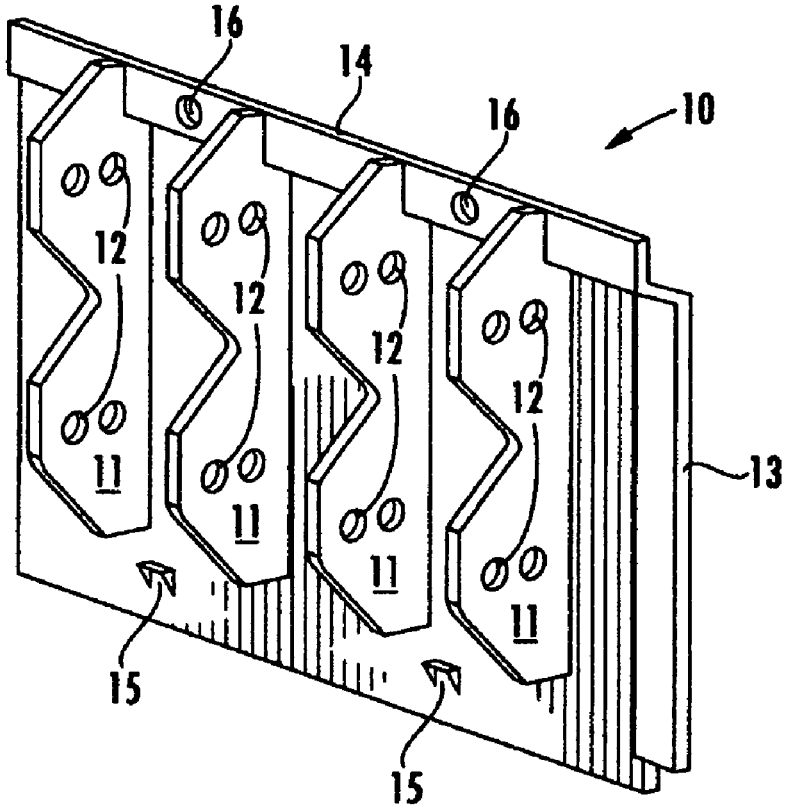
FIG. 1 is a perspective rear view of a face panel of the instant invention showing four flanges extending therefrom.
Figure 2:
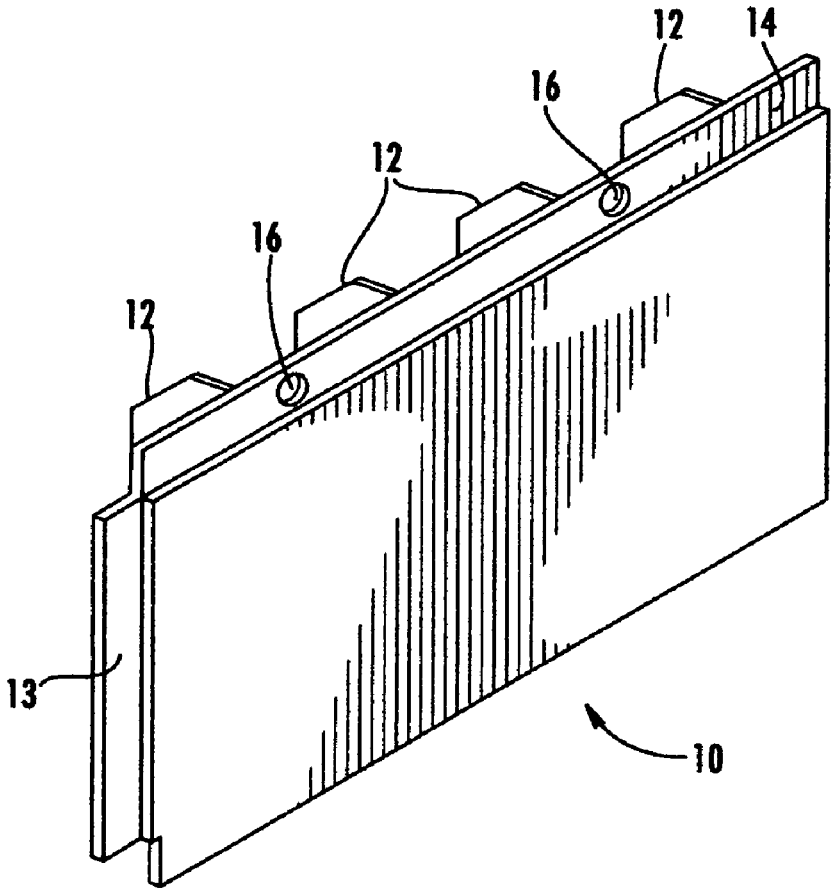
FIG. 2 is a perspective front view of a face panel of the instant invention.

Referring now to FIG. 1, therein is shown a perspective rear view of a preferred face panel 10 of the instant invention molded of a thermoplastic polymer or resin such as, without limitation thereto, impact modified polystyrene, polyethylene, PVC, PVC structural foam or a thermoset resin such as, without limitation thereto, a phenol-formaldehyde resin. The face panel 10 has four flanges 11 extending perpendicularly therefrom and integrally molded therewith. Each flange 11 is perforated therethrough with a plurality of apertures 12. Referring now to FIG. 2, therein is shown a perspective front view of the face panel of 10 of FIG. 1. It should be understood that the face panels of the instant invention can be made of any suitable material such as, without limitation thereto, galvanized sheet steel, sheet aluminum and wood or wood compositions such as chip board. Preferably, the face panels of the instant invention are made of thermoplastic or thermoset resins. It should be understood that when the panels and/or fasteners of the instant invention are made of molded thermoplastic, then recycled thermoplastic can be used to help advance the quality of the environment.

Figure 3:
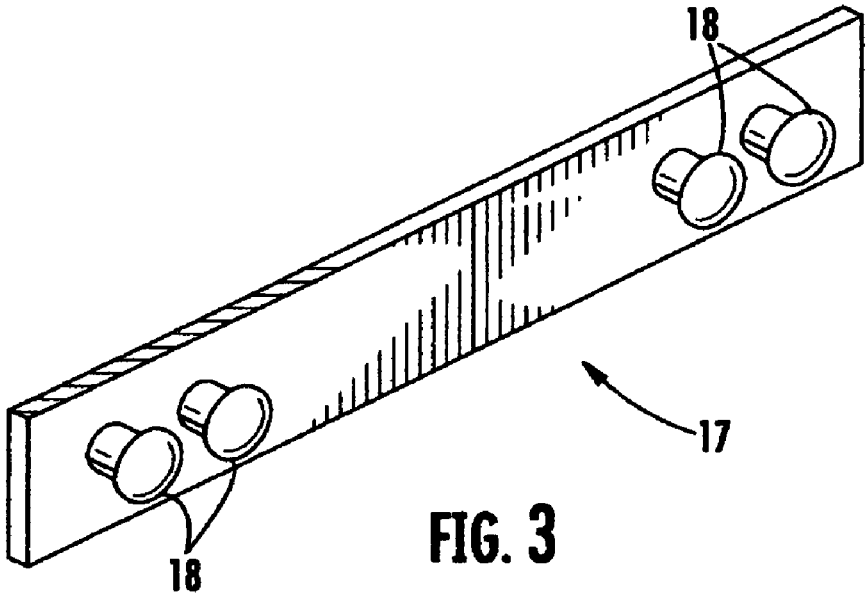
FIG. 3 is a perspective view of a snap-strap of the instant invention.
Figure 4:
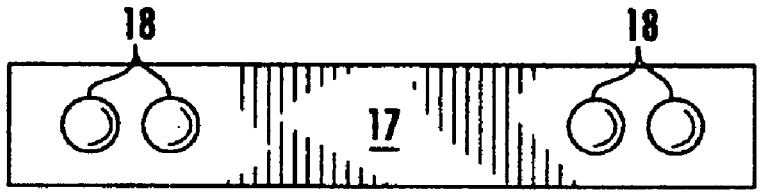
FIG. 4 is a top view of the snap-strap of FIG. 3.
Figure 5:
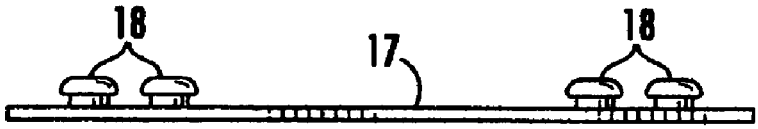
FIG. 5 is a side view of the snap-strap of FIG. 3.

Referring now to FIG. 3, therein is shown a perspective view of a preferred "snap-strap" 17 of the instant invention molded of a thermoplastic polymer or resin such as, without limitation thereto, a plasticized polyvinyl chloride material or a thermoset resin such as, without limitation thereto, a polyurethane resin. The strap 17 comprises projections 18 therefrom molded integrally therewith. The projections 18 are dimensioned to be an interference fit when pressed through an aperture 12 of a flange 11 of the face panel 10 shown in FIG. 1. FIG. 4 shows a top view of the snap-strap 17 of FIG. 3. FIG. 5 shows a side view of the snap-strap 17 of FIG. 3.

Figure 6:
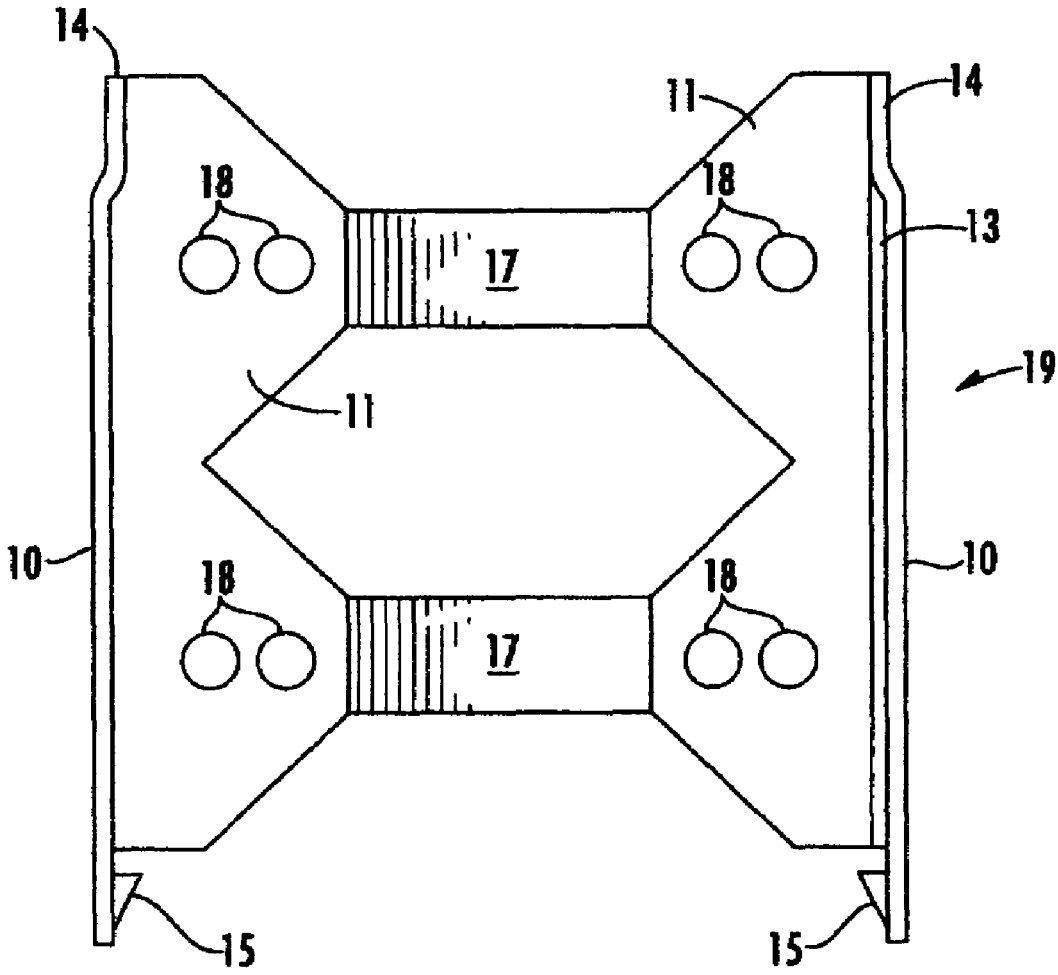
FIG. 6 is a an end view of a pair of face panels of FIG. 1 attached to each other using snap-straps as shown in FIG. 3.
Figure 7:
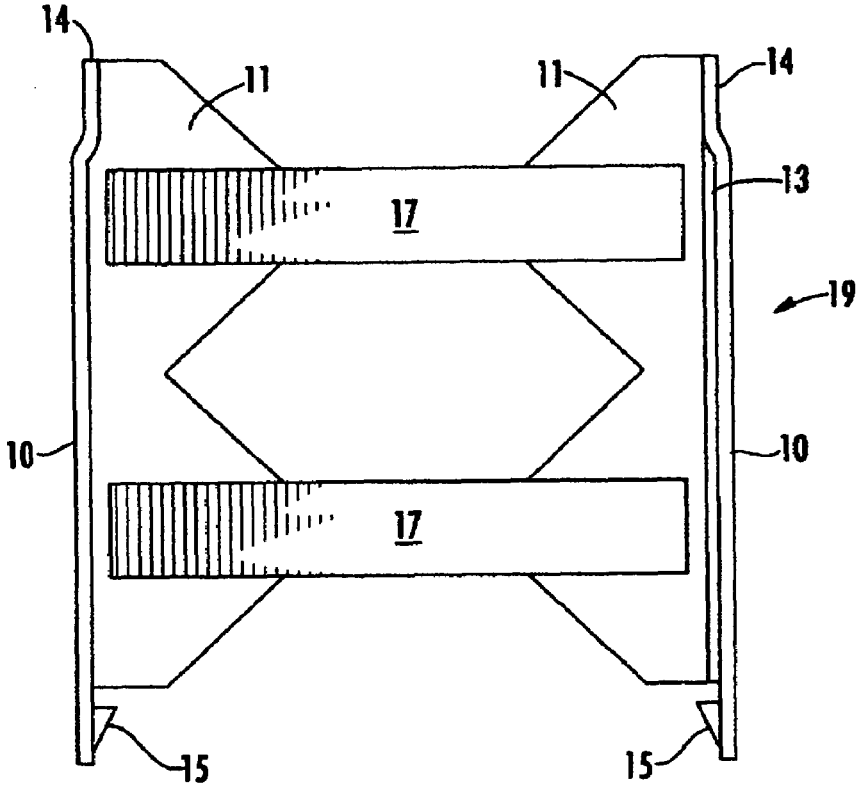
FIG. 7 is an end view from the other end of the assembly shown in FIG. 6.

Referring now to FIG. 6, therein is shown an end view of a hollow block structure 19 assembled when the projections 18 of the snap-straps 17 are pressed through the apertures of the flanges 11 of the face panels 10. Referring now to FIG. 7, therein is shown an end view of the hollow block structure 19 of FIG. 6 from the other end. In use, a number of block structures 19 are arrayed in a horizontal course with the side aligning tabs 13 fitted under the adjoining face panel. Then another horizontal course of block structures 19 is pressed in staggered fashion above the first course so that locking tabs 15 (also called snap buttons herein) of the face panels 10 engage with the holes or openings 16 in the upper aligning tabs 14. Then, if desired, additional horizontal courses of block structures 19 are laid until the wall or footing form is as high as desired. Reinforcing steel rods can, of course, be inserted as desired as the courses are laid. If larger panels are used, then a wall can be formed from one course of the block structures of the instant invention.

Referring again to FIG. 5, it will be noted that the preferred shape of the projections 18 is in the form of a chevron in cross-section. However, it should be understood that other shapes (such as a spheroid) can be used if desired. The outside diameter of the projections 18 is somewhat larger than inside diameter of the apertures 12 so that the projections 18 are an interference fit when the projections 18 are pressed through the apertures 12 to assemble the block structure 19 of FIG. 6.

Referring again to FIG. 1, it is preferable to mold four flanges 11 from the face plate 10 as shown so that half or even quarter blocks can be assembled by sawing the face plate 10 in half or in quarters. Although the block assembly 19 of FIGS. 6 and 7 is assembled from identical face plates 10, it should be understood that a face plate which is a mirror image of the face plate 10 is preferred so that the side aligning tabs of a block assembly face the same direction.

Figure 8:
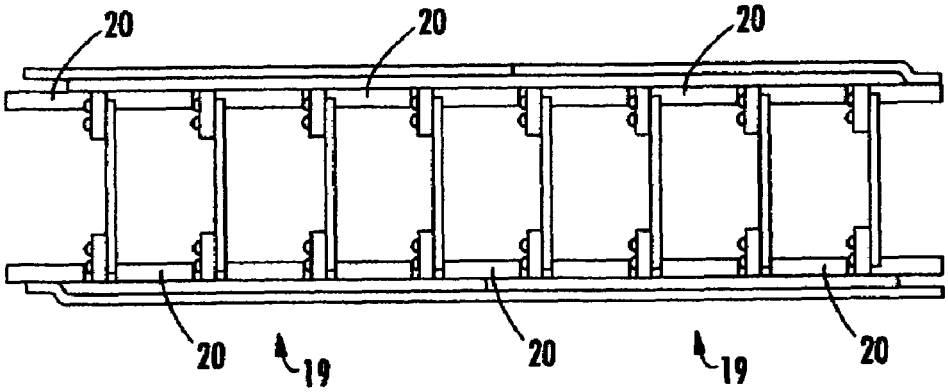
FIG. 8 is a top view of two of the assemblies of FIGS. 6 and 7 engaged end to end and also showing a number of insulation panels.

Referring now to FIG. 8, therein is shown a top view of two of the assemblies 19 of FIGS. 6 and 7 engaged end to end. Closed cell polystyrene foam thermal insulation panels 20 are then inserted as shown and are highly preferred as providing not only thermal insulation but added strength to the form to withstand the hydraulic pressure of the fluid concrete poured into the form before the fluid concrete cures. And, if larger panels are used, then an insulated wall, insulated with, for example and without limitation thereto, fiberglass or blown-in cellulose insulation, can be formed from one course of the block structures of the instant invention even if the wall is not filled with concrete.

The exterior and/or interior of the face panels of the instant invention are preferably "finish-faced". The term "finish-faced" means an external surface not requiring further finishing. Such an external surface could be, for example and without limitation thereto, a stucco type of surface or vertical lines that could disguise, if desired, the vertical joints of the wall. The face panels can, of course, be molded of a colored thermoplastic or thermoset polymer or resin so that the finished wall does not require painting. The instant invention can be used, of course, to make footings, foundation walls and walls above grade.

An important benefit of the instant invention is that by the use of snap-straps of different lengths, walls and the like can be constructed of different thicknesses. The use of relatively long face panels of appropriate design permits the ready adaptation of the instant invention to the construction of curved walls.

Figure 9:
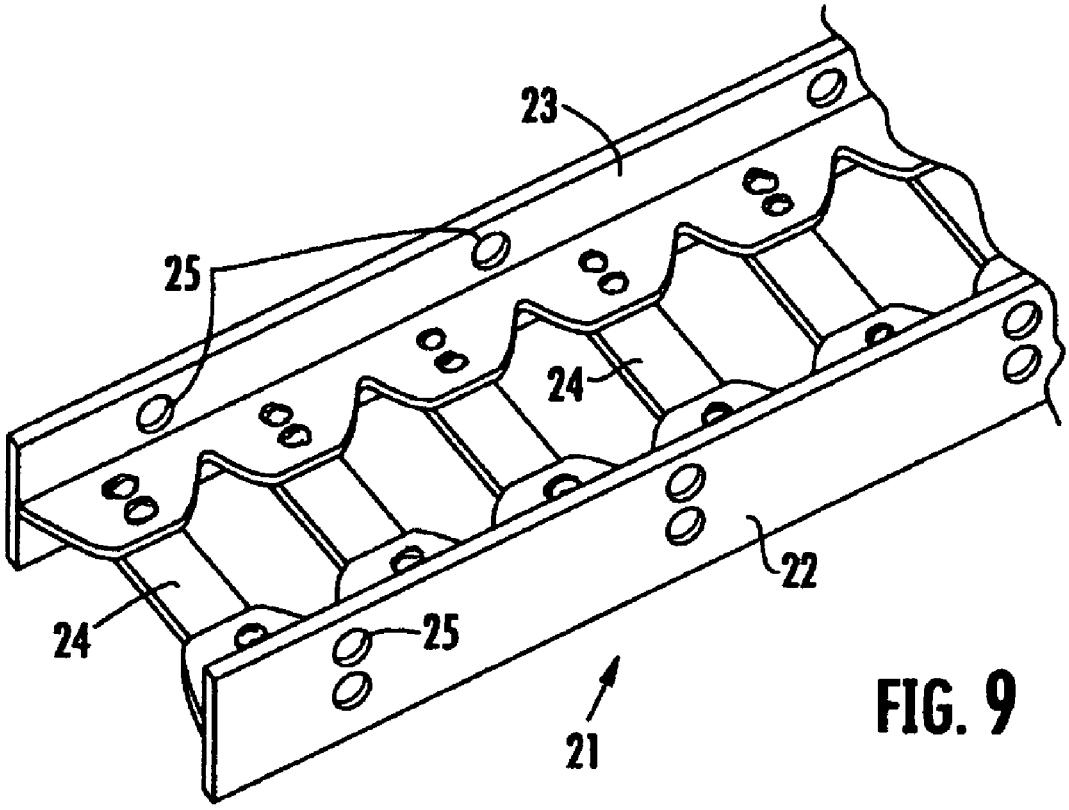
FIG. 9 is a perspective view of a base-plate system for use with the block assembly of the instant invention.

Referring now to FIG. 9, therein is shown a base-plate system 21 for use with the hollow blocks of the instant invention. The base-plate system 21 consists of a front face 22 and a rear face 23 connected by snap straps 24 (all of which are preferably injection molded of a thermoplastic or thermoset resin). In use, the base plate system 21 can be, for example, grouted to a footing. The locking tabs (15 of FIG. 6) of the first course of hollow blocks of the instant invention are then located over and pressed into the holes 25 in the front and rear faces 22 and 23. Alternatively, the first course of hollow blocks of the instant invention can simply be grouted to the footing.

Figure 10:
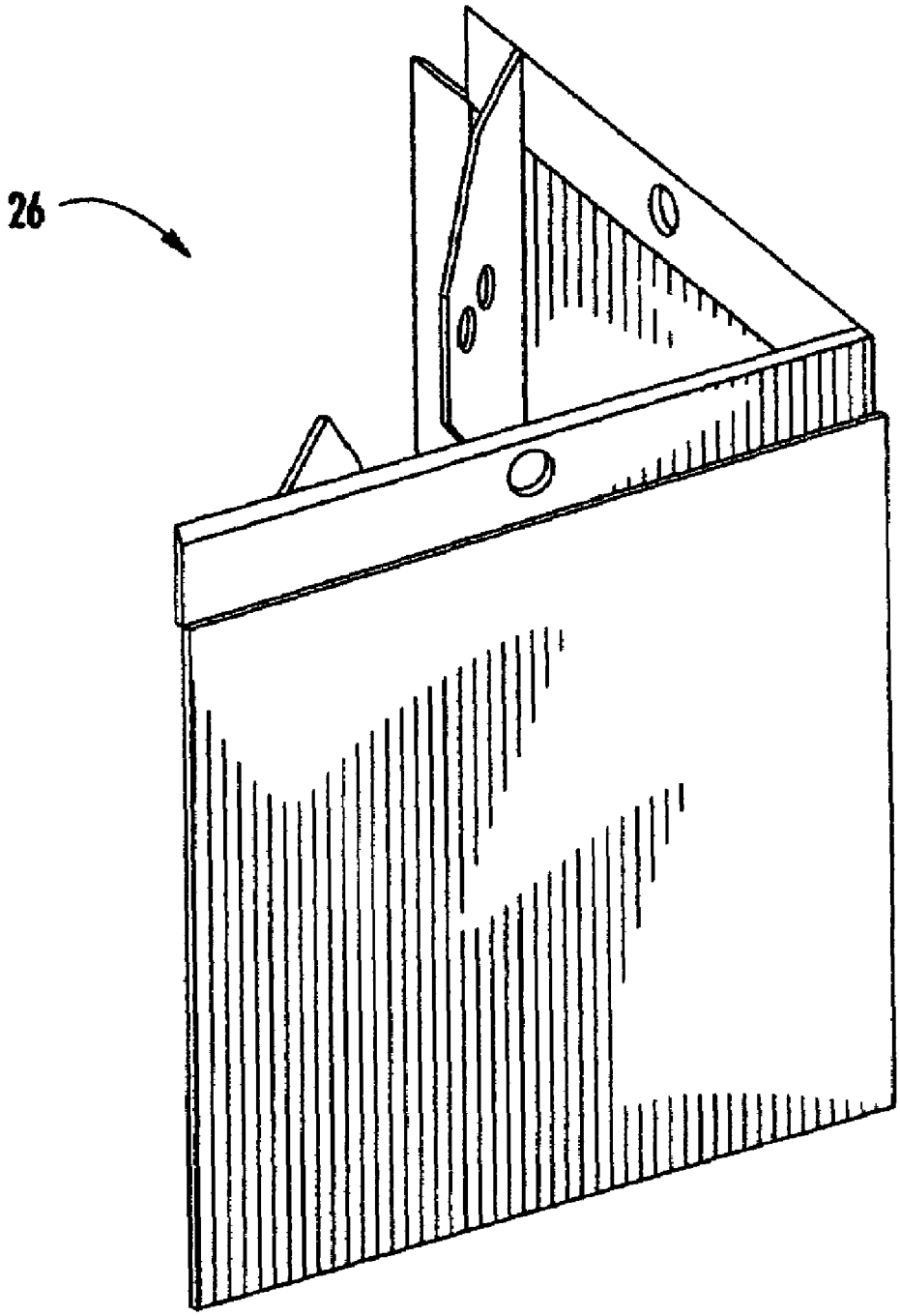
FIG. 10 is a perspective view of half block outer corner for use with the block assembly of the instant invention.
Figure 11:
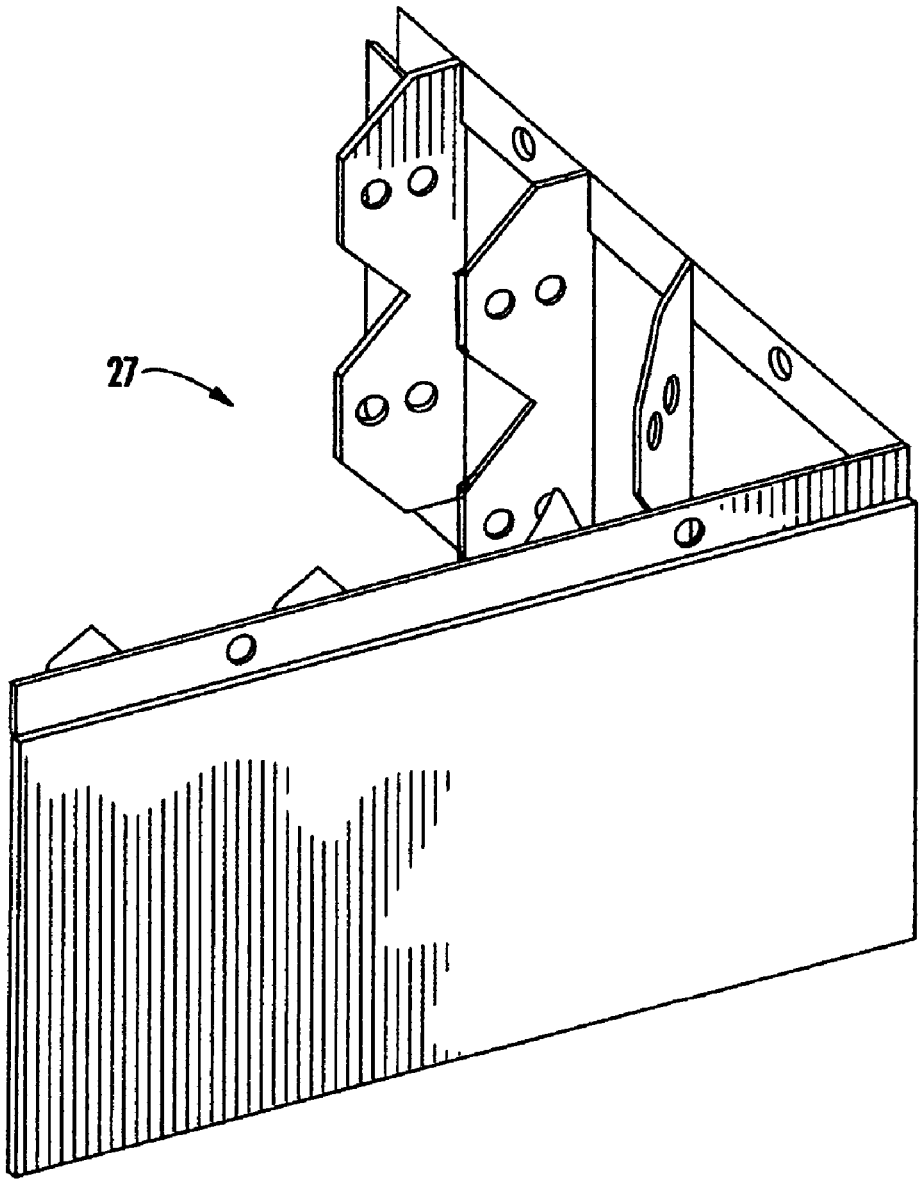
FIG. 11 is a perspective view of full block outer corner for use with the block assembly of the instant invention.
Figure 12:
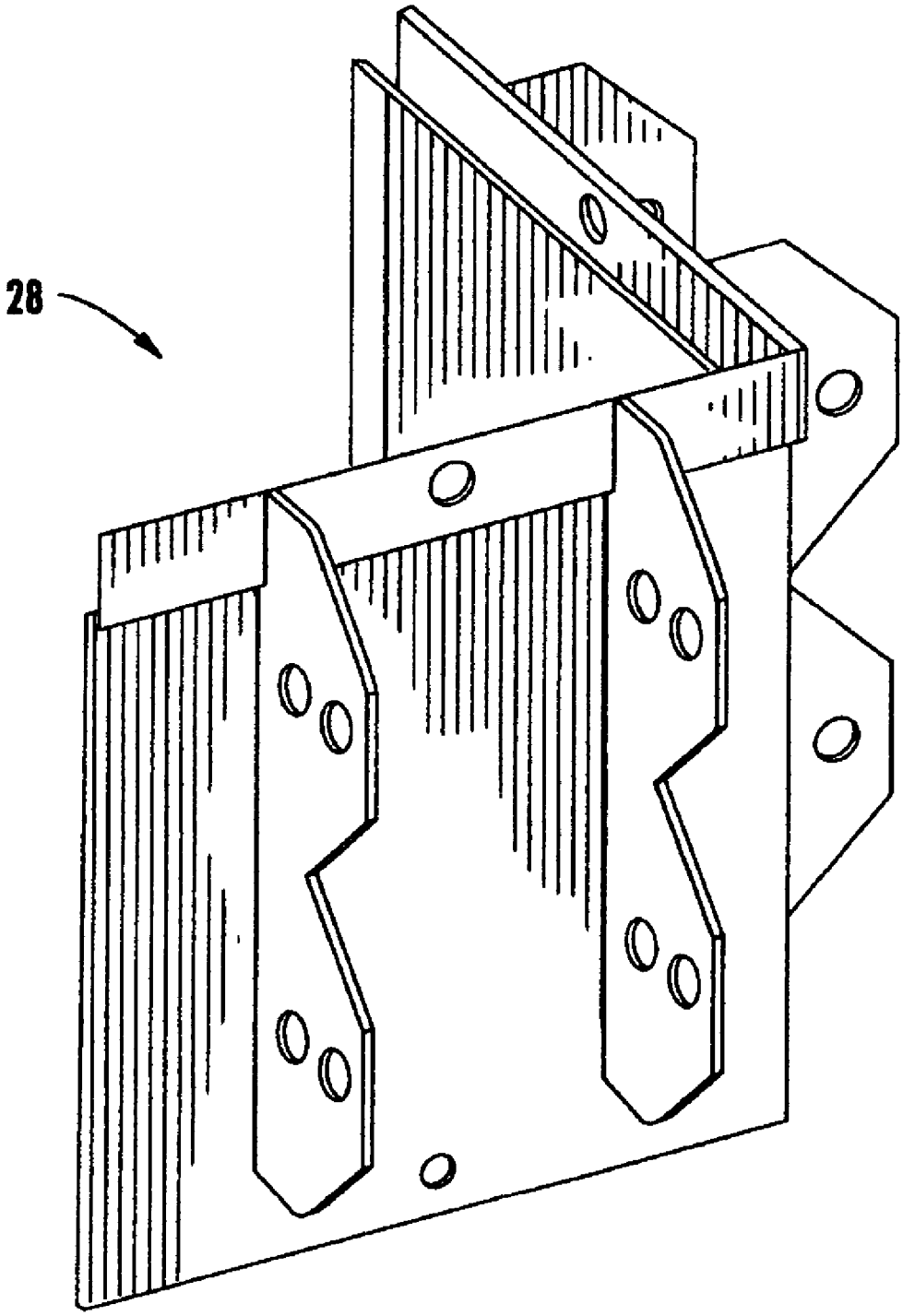
FIG. 12 is a perspective view of an inner corner for use with the block assembly of the instant invention.
Figure 13:
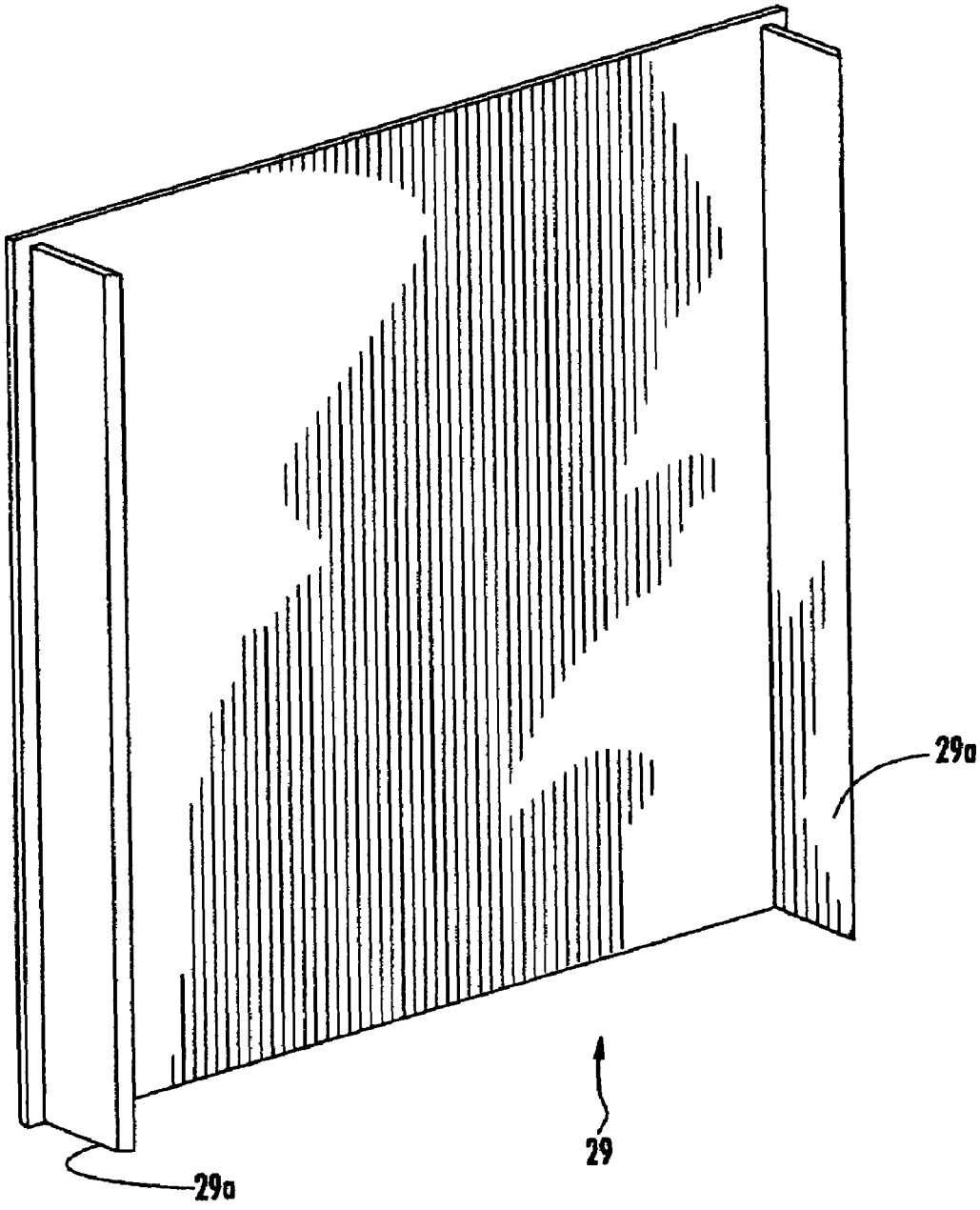
FIG. 13 is a perspective view of an end cap for use with the block assembly of the instant invention.
Figure 14:
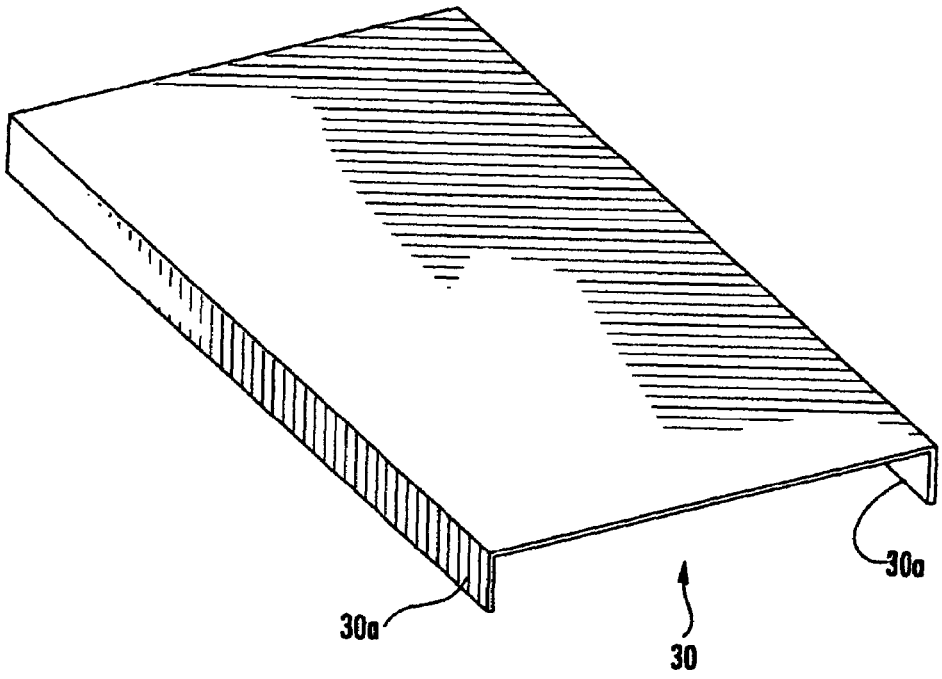
FIG. 14 is a perspective view of a top cap for use with the block assembly of the instant invention.

Referring now to FIG. 10, therein is shown a perspective view of a preferred half block outer corner 26 for use with the hollow blocks of the instant invention which is preferably also molded of a thermoplastic or thermoset resin. Referring now to FIG. 11, therein is shown a perspective view of a preferred full block outer corner 27 for use with the hollow blocks of the instant invention which is preferably also molded of a thermoplastic or thermoset resin. Referring now to FIG. 12, therein is shown a perspective view of a preferred full inner corner 28 for use with the hollow blocks of the instant invention which is preferably also molded of a thermoplastic or thermoset resin. Referring now to FIG. 13, therein is shown a perspective view of a preferred end cap 29 for use with the hollow blocks of the instant invention (which is preferably also molded of a thermoplastic or thermoset resin) if it is desired to end a wall or footing. The end cap 29 can be held in place by screws, not shown, driven through the end of a hollow block to engage the tabs 29*a* of the end cap 29. Referring now to FIG. 14, therein is shown a perspective view of a preferred top cap 29 for use with the hollow blocks of the instant invention (which is preferably also molded of a thermoplastic or thermoset resin) if it is desired to finish the top of a wall or footing. The top cap 29 preferably has locking tabs (like the locking tabs 15 of FIG. 1) molded with the skirt 30*a* of the top cap 29 to engage with the holes in the aligning tabs of the hollow block of the instant invention.

Figure 15:
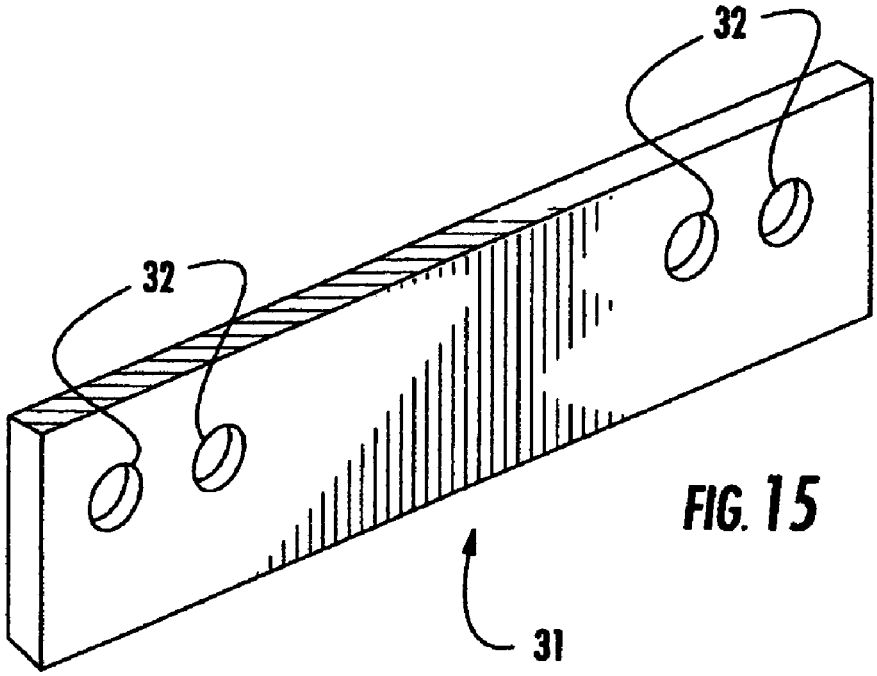
FIG. 15 is a perspective view of a perforated strap for use in the instant invention.
Figure 16:
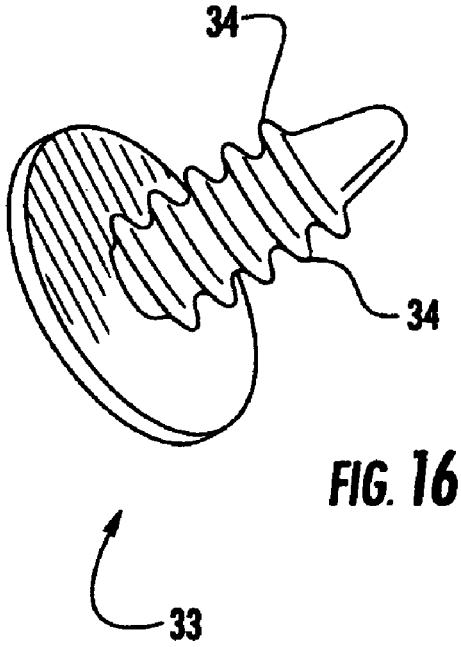
FIG. 16 is a perspective view of a press-fit fastener for use in the instant invention.

The snap strap 17 of FIG. 3 is an example of a fastener for the indirect connection of a flange of one face panel to a flange of another face panel. Referring now to FIG. 15, therein is shown a strap 31 perforated therethrough with apertures 32. Of course, the flanges of the face plates discussed above can be molded or otherwise formed to have projections which are dimensioned to be an interference fit when pressed through the apertures 32 of the strap 31. And, of course, the flanges of one panel can have apertures while the corresponding flanges of the other panel can be molded or otherwise formed to hae projections which are dimensioned to be an interference fit when pressed through said apertures. However, referring now to FIG. 16, therein is shown a "X-Mass Tree Clip" fastener" 33 available from K-International of Gurnee, Ill. Thirty two of such fasteners 33 can be used to attach one face plate 10 of FIG. 1 to another face plate 10 of FIG. 1 by pressing said fasteners through the apertures 32 of the strap 31 of FIG. 15 and the apertures 12 of the face plate 10 of FIG. 1 to produce a block assembly similar to the block assembly 19 of FIG. 6. The outside diameter of the chevrons 34 of the fastener 33 are dimensioned to be an interference fit in the apertures 32 and 12. A simple length of wire can be used as a fastener to attach one panel to another panel by passing the wire through the apertures of the flanges of the panels and bending the wire around the apertures. The fastener 33 is but one example of a whole family of press-fit fasteners which are commercially available. For example, and without limitation thereto, said K-International offers snap rivets, Viking clips, quick grip fasteners, dart clips, ratchet rivet fasteners and arrow clips. And, of course, conventional fasteners such as nuts and bolts can also be used.

Figure 17:
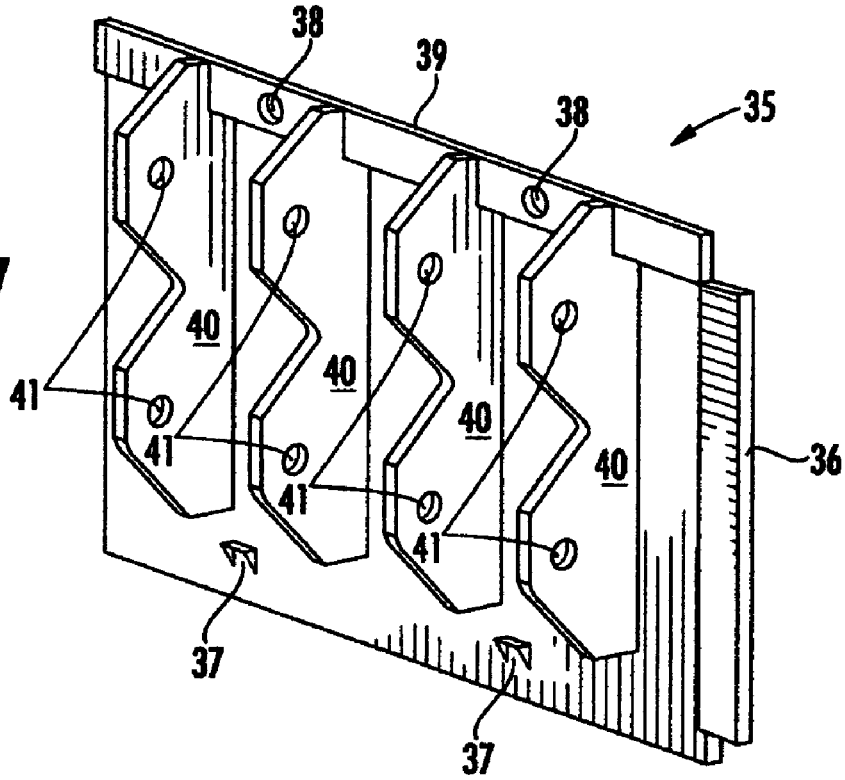
FIG. 17 is a perspective rear view of another face panel of the instant invention showing four flanges extending therefrom.

Referring now to FIG. 17, therein is shown a perspective rear view of a preferred face panel 35 of the instant invention molded of a thermoplastic polymer or resin such as, without limitation thereto, impact modified polystyrene, polyethylene or a thermoset resin such as, without limitation thereto, a phenol-formaldehyde resin. The face panel 35 has four flanges 40 extending perpendicularly therefrom and integrally molded therewith. Each flange 40 is perforated therethrough with a plurality of apertures 41. Each panel 35 has side aligning tabs 36, upper aligning tabs 39, holes 38 and locking tabs 37. Two panels 35 can be joined together by pressing fasteners 33 of FIG. 16 through the apertures 41 of each face plate 35. Alternatively, any desired fastener can be used for this purpose.

Figure 18:
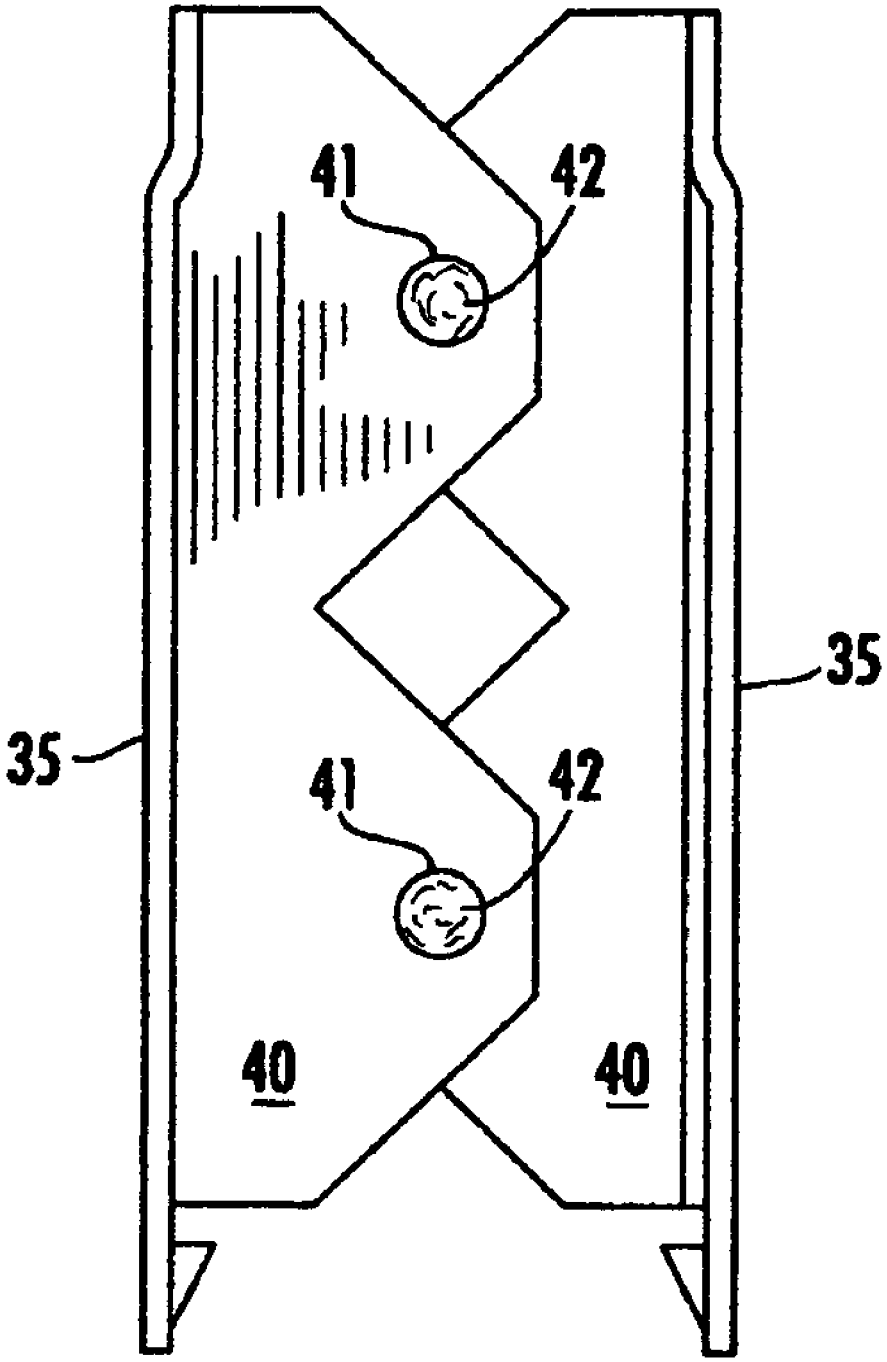
FIG. 18 is an end view of a pair of the face panels of FIG. 17 attached to each other using steel concrete reinforcing rods.

Referring now to FIG. 18, when it is desired to produce a poured reinforced concrete wall, a preferred fastener for connecting the face panels together is a number of steel concrete reinforcing rods 42 positioned in the apertures 41 of the panels 35 of FIG. 17. Preferably, the outside diameter of the rods 42 is smaller than the inside diameter of the apertures 41.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains and which fall within the limits of the following claims.

What is claimed is:

1. A kit for forming a hollow block assembly to be used to construct a wall, the kit comprising: at least two face panels and a plurality of fasteners, each face panel comprising a plurality of spaced apart flanges extending perpendicularly from and attached to each panel so that a hollow block structure is assembled when the flanges of the face panels are connected together, directly or indirectly, by the fasteners, wherein the face panels are molded of a resin selected from the group consisting of a thermoplastic resin and a thermoset resin, wherein the flanges of the face panels are integrally molded with the face panels, wherein each flange of the face panels is perforated therethrough with a plurality of apertures and wherein each fastener is a snap-lock strap molded of a resin selected from the group consisting of a thermoplastic resin and a thermoset resin and comprising projections therefrom molded integrally therewith, the projections dimensioned to be an interference fit when pressed through an aperture of a flange so that a hollow block structure is assembled when the projections of the straps are pressed through the apertures of the flanges of the face panels.

2. The kit of claim 1, further comprising a plurality of straps molded of a resin selected from the group consisting of a thermoplastic resin and a thermoset resin the straps being perforated therethrough with a plurality of apertures so that a hollow block structure is assembled when the flanges of the face panels are connected together by way of the straps with the fasteners passing through the apertures of the flanges and the straps.

3. The kit of claim 1, further comprising a pair of openings positioned at the top edge of each panel and a pair of corresponding snap buttons positioned at the bottom edge of each panel.

4. A kit for forming a hollow block assembly to be used to construct a wall, the kit comprising: at least two face panels and a plurality of fasteners, each face panel comprising a plurality of spaced apart flanges extending perpendicularly from and attached to each panel so that a hollow block structure is assembled when the flanges of the face panels are connected together, directly or indirectly, by the fasteners, wherein the face panels are molded of a resin, selected from the group consisting of a thermoplastic resin and a thermoset resin, wherein the flanges of the face panels are integrally molded with the face panels, wherein each flange of the face panels is perforated therethrough with a plurality of apertures and wherein each fastener is a press-fit fastener molded of a resin selected from the group consisting of a thermoplastic resin and a thermoset resin and dimensioned to be an interference fit when pressed through the apertures of the flanges of one panel aligned with the flanges of another panel.

5. A hollow block assembly to be used to construct a wall, comprising: two face panels, each face panel comprising a plurality of spaced apart flanges extending perpendicularly from and attached to each panel, the flanges of one face panel facing and aligned With the flanges of the other face panel; and a plurality of fasteners connecting the flanges together wherein the face panels are molded of a resin selected from the group consisting of a thermoplastic resin and a thermoset resin wherein the flanges of the face panels are integrally molded with the face panels wherein each flange of the face panels is perforated therethrough with a plurality of apertures, and wherein each fastener is a snap-lock strap molded of a resin selected from the group consisting of a thermoplastic resin and a thermoset resin and comprising projections therefrom molded integrally therewith, the projections dimensioned to be an interference fit when pressed through an aperture of a flange so that a hollow block structure is assembled when the projections of the straps are pressed through the apertures of the flanges of the face panels.

6. A hollow block assembly to be used to construct a wall, comprising: two face panels, each face panel comprising a plurality of spaced apart flanges extending perpendicularly from and attached to each panel, the flanges of one face panel facing and aligned with the flanges of the other face panel; and a plurality of fasteners connecting the flanges together wherein the face panels are molded of a resin selected from the group consisting of a thermoplastic resin and a thermoset resin wherein the flanges of the face panels are integrally molded with the face panels wherein each flange of the face panels is perforated therethrough with a plurality of apertures, and wherein each fastener is a press-fit fastener molded of a resin selected from the group consisting of a thermoplastic resin and a thermoset resin and dimensioned to be an interference fit when pressed through the apertures of the flanges.

7. A hollow block assembly to be used to construct a wall, comprising: two face panels, each face panel comprising a plurality of spaced apart flanges extending perpendicularly from and attached to each panel, the flanges of one face panel facing and aligned with the flanges of the other face panel and a plurality of fasteners connecting the flanges together, wherein the face panels are molded of a resin selected from the group consisting of a thermoplastic resin and a thermoset resin, wherein the flanges of the face panels are integrally molded with the face panels, wherein each flange of the face panels is perforated therethrough with a plurality of apertures, further comprising a plurality of straps molded of a resin selected from the group consisting of a thermoplastic resin and a thermoset resin, the straps being perforated therethrough with a plurality of apertures so that the hollow block structure is assembled when the flanges of the face panels are connected together by way of the straps with the fasteners passing through the apertures of the flanges and the straps.

8. A hollow block assembly to be used to construct a wall, comprising: two face panels, each face panel comprising a plurality of spaced apart flanges extending perpendicularly from and attached to each panel, the flanges of one face panel facing and aligned with the flanges of the other face panel; and a plurality of fasteners connecting the flanges together, wherein the face panels are molded of a resin selected from the group consisting of a thermoplastic resin and a thermoset resin, wherein the flanges of the face panels are integrally molded with the face panels, wherein each flange of the face panels is perforated therethrough with a plurality of apertures, further comprising a pair of openings positioned at the top edge of each panel and a pair of corresponding snap buttons positioned at the bottom edge of each panel so that when a second course of blocks is positioned on a first course of blocks, the snap buttons of the second course of blocks snap into the openings of the first course of blocks.

* * * * *